US005652936A

United States Patent [19]

Klees et al.

[11] Patent Number: 5,652,936

[45] Date of Patent: Jul. 29, 1997

[54] AUTOMATED PHOTOFINISHING APPARATUS WITH CONVENIENT ORDER STATUS CHECKING FEATURE

[75] Inventors: Kevin John Klees; Mark Rollin Mosher, both of Rochester, N.Y.

[73] Assignee: Eastman Kodak Company, Rochester, N.Y.

[21] Appl. No.: 597,096

[22] Filed: Feb. 6, 1996

[51] Int. Cl.[6] ..... G03D 13/00

[52] U.S. Cl. ..... 396/564

[58] Field of Search ..... 354/247, 308–313, 354/322–324, 331, 336; 364/479.06, 526, 478.13; 340/825.35, 286.06; 396/564, 578, 610, 623, 624, 626, 630, 636, 638

[56] References Cited

U.S. PATENT DOCUMENTS

| | | | |
|---|---|---|---|
| 3,534,357 | 10/1970 | Purney, Sr. | 340/286.06 |
| 4,675,647 | 6/1987 | Salin et al. | 340/286 R |
| 4,740,074 | 4/1988 | Powell | 396/578 |
| 4,935,720 | 6/1990 | Kalfoun | 340/286.09 |
| 5,109,247 | 4/1992 | Kuruya et al. | 396/610 |
| 5,113,351 | 5/1992 | Bostic | 364/479.06 |

FOREIGN PATENT DOCUMENTS

| | | | |
|---|---|---|---|
| 7-262460 | 10/1995 | Japan | 396/915 |
| WO89-8901 | 9/1989 | United Kingdom | 354/310 |

*Primary Examiner*—D. Rutledge
*Attorney, Agent, or Firm*—Frank Pincelli

[57] ABSTRACT

An apparatus for receiving undeveloped film and for delivering prints and developed film to a customer. The apparatus comprises a workstation for interaction of a customer at the apparatus thereby providing instructions to the customer for ordering processing of an undeveloped photosensitive material. The workstation includes a first display device for providing instructions and information to the customer for use in said apparatus, for entering data responsive to said instructions; an acceptance device for receiving image data; a printing mechanism for issuing a customer claim check having a unique identification indica; and a second display visually separate from the workstation for displaying the status of various customer orders.

34 Claims, 3 Drawing Sheets

AUTOMATED PHOTOFINISHING APPARATUS WITH CONVENIENT ORDER STATUS CHECKING FEATURE

FIELD OF THE INVENTION

The present invention relates to photofinishing equipment, and more particularly, to customer access photofinishing machine.

BACKGROUND OF INVENTION

U.S. Pat. No. 5,113,351 discloses an automated interactive film processing system which eliminates all human handling of film once it is deposited by the customer. The system includes an apparatus which accepts film products and information concerning a customer order at a customer service station having a display screen for communicating information to the customer. The machine at the same station accepts an exposed film cartridge, accepts payment for processing, and prints a receipt claim check. The customer would then leave the apparatus and return at some later time, which may be indicated on the claim check, to pick up their developed film and prints. Upon returning to the apparatus, the customer would enter the unique order number from their claim check via a user interface.

One problem with the foregoing system is the need for a customer to enter a number into the machine just to determine if their order is ready. A Customer may have to wait behind several other customers just to determine if their order is ready. This can be very frustrating if the order is not ready. Therefore, it is desirable to provide a simple, quick, and economical method for allowing a customer to check the status of the order, especially when another customer is using the customer user interface.

The present invention proposes to solve this problem by providing an appropriate visual indicator on the device that can be easily viewed or accessed by the customer while someone is at the main customer user interface. The visual display displays orders that are completed and ready to be claimed. There would be no need for the customer to enter any information into the device, by way of keypad or other means at the service station, in order to determine the status of his or her order.

SUMMARY OF THE INVENTION

In accordance with one aspect of the invention, there is provided an apparatus for receiving undeveloped film and for delivering prints and the developed film to a customer. The apparatus comprises a workstation for interaction of a customer at the apparatus thereby providing instructions to the customer for ordering processing of an undeveloped photosensitive material. The workstation includes a first display device for providing instructions and information to the customer for use in the apparatus, for entering data responsive to the instructions; an acceptance device for receiving image data; a printing mechanism for issuing a customer claim check having a unique identification indica; and a second display visually separate from the workstation for displaying the status of various customer orders.

In accordance with another aspect of the present invention there is provided an automated interactive photofinishing apparatus for receiving undeveloped film, developing the film, printing prints from the developed film, storing the developed film and prints, and a delivery mechanism for dispensing the developed film and associated prints. The apparatus comprises a workstation for interaction of a customer at the apparatus and for providing instructions to the customer for starting the processing of an undeveloped photosensitive material. The workstation includes a first display device for providing instructions and information to the customer for using the apparatus; an input device for entering data responsive to the instructions displayed; an acceptance device for receiving image data; a printing device for issuing a customer claim check having a unique identification indica; and a second display device visually separate from the workstation for displaying the status of various customer orders.

These and other advantages of the present invention will be more clearly understood and appreciated from a review of the following detailed description and appended claims, and by reference to the accompanying drawings.

BRIEF DESCRIPTION 0F THE DRAWINGS

DETAILED DESCRIPTION OF THE INVENTION

Figure 1:
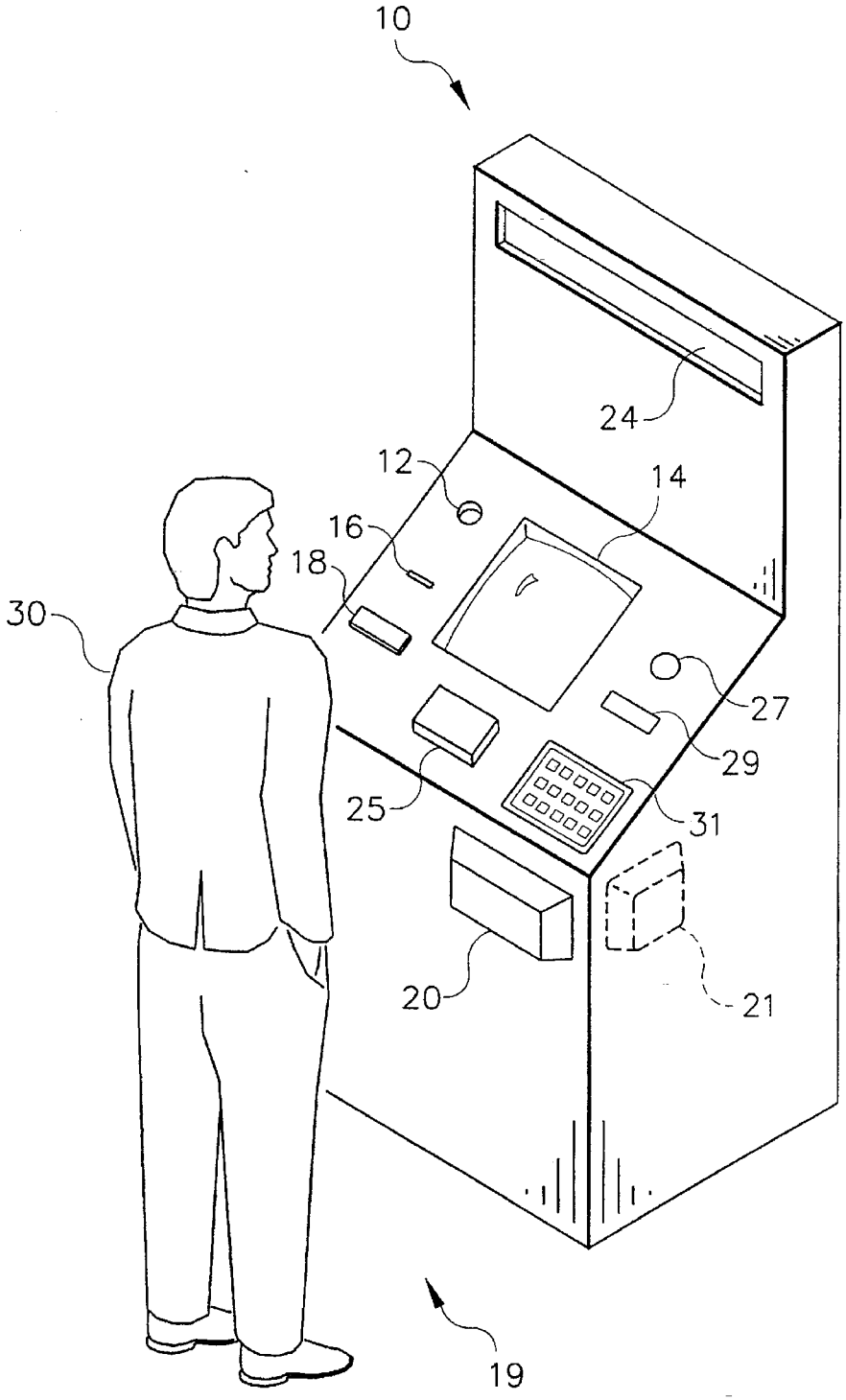
FIG. 1 is a perspective view of an automated photofinishing apparatus made in accordance with the present invention.

Referring to FIG. 1, there is illustrated an automatic photofinishing apparatus 10 made in accordance with the present invention. The apparatus 10 includes a film acceptance mechanism 12 for accepting image data, a touch screen video display 14 (for example, a CRT) for displaying customer order instructions and for entering customer order data by the customer, a payment mechanism 16, a claim check printer 18, and a completed order delivery mechanism 20 for delivery of completed customer orders. The apparatus 10 further includes a central processing unit (computer) 21, which is used to control operation of the apparatus and the various components thereof. In the embodiment illustrated, acceptance mechanism 12 is designed to receive a roll of undeveloped film contained in a typical film cartridge. It is to be understood that the mechanism 12 may be designed to accept any desired format and size film or other photosensitive material.

The film acceptance mechanism 12, touch screen video display 14, payment mechanism 16, and completed order delivery mechanism 20 are arranged so as to comprise a customer workstation 19 whereby the customer 30 can fully interact with the apparatus 10. In order to assure privacy, the workstation 19 is designed for use by a single customer 30.

The apparatus 10 further includes a customer order status display 24 which is positioned at a location visually separate from the customer workstation 19 such that it can be clearly seen by other customers while a first customer is at the customer workstation 19. In the embodiment illustrated display 24 is an LCD (Liquid Crystal Display), however, display 24 may be a CRT, LED display, or any other type visual display so desired. By placing the status display 24 at such a visually separate location, it is possible for customers, other than the customer currently working at the workstation 19, to see the status display 14 and thus determine whether or not their order is ready. Additional image data acceptance means may be provided such as an optional scanning device 25 for scanning developed film and/or prints so as to provide a digital record of images to be printed, and/or an appropriate input device for entering a digital record of an image, for example, but not by way of limitation, an input port 27 or computer disc reader 29 may be provided for capturing the digital record.

The apparatus 10 is preferably designed to be of the stand alone type device that can fully complete the customers order from developing of the undeveloped film to printing of the final prints, storing of the finished order, and dispensing the completed order. Examples of such devices are disclosed and described in U.S. Pat. No. 5,113,351 and co-pending U.S. provisional patent applications entitled "Stand Alone Photofinishing Apparatus" filed Sept. 12, 1995, Ser. No. 60/003,637, by Mark M. Meyers, and "Automated Photofinishing Apparatus", filed Jun. 26, 1995, Ser. No. 60/000,519, and U.S. application Ser. No. 08/576,721, filed Dec. 21, 1995, by Richard B. Wheeler and Daniel M. Pagano , which claims priority from the Ser. No. 60/000,519 application, all of which are hereby incorporated by reference. Thus the apparatus 10 would have an internal storage and delivery mechanism, such as described in U.S. Pat. No. 5,113,531, or in the above identified patent applications, for storage and delivery of the developed film and prints to the order delivery mechanism 20 upon activation of the apparatus and payment by the customer.

Figure 2:
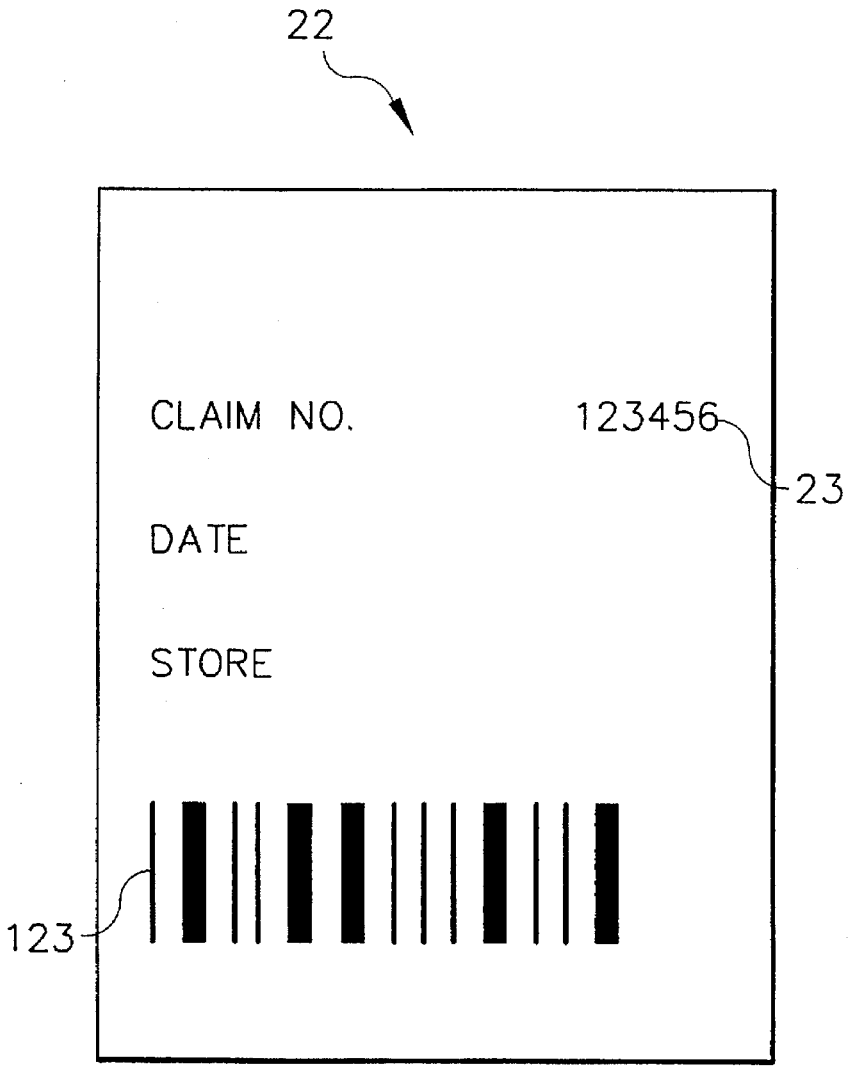
FIG. 2 illustrates a customer order claim check issued by the apparatus of FIG. 1.

The normal ordering process starts when a customer 30 approaches the apparatus 10 and makes the apparatus active, for example, by pressing the touch screen video display 14 at workstation 19. A prompt is displayed on video display 14 which would then request that the customer 30 swipe their credit card or make appropriate payment to the payment mechanism 16. After appropriate payment has been made, the customer would be prompted to insert the film cartridge and/or film into the film acceptance mechanism 12 (or other acceptance device). The customer would then enter appropriate customer order information in response to inquiries prompted by the display 14. In the embodiment illustrated the customer uses a touch screen display for entering of data. After the customer has completed entering the order, the claim check printer 18 would print a claim check 22 (see FIG. 2) with a unique identification indica, such as identification number 23, which would represent that particular customer order. The customer would then leave the apparatus 10, taking the claim check 22 with them. This order entry process, due to the information to be supplied by the customer, can be relatively quick, or take up to five (5) minutes or longer for complex orders, particularly if scanning of developed film and/or prints is being done.

In order for the customer to check on the status of the order, the customer need only approach the apparatus such that he can visually inspect the status display 24. If there is insufficient space for illustrating all of the customer orders that have been completed on the status display 24, the claim check numbers can be scrolled across the status display 24 as appropriate. The display 24 could be programmed to continuously display completed customer orders for a predetermined period of time, for example, 1 hour, 2 hours, or 1 day. It would normally be assumed that if the customer does not pick up the order at that point, the customer would return a different day. Under this assumption, other customers who are waiting to receive their order as soon as possible would have their order status displayed. In this event, the customer coming back another day could then go to the workstation 19 and activate the display screen 14 so as to query if the customer order is ready.

Various modifications, or changes can be made without departing from the scope of the present invention. For example, in the embodiment illustrated in FIG. 1, a touch screen video display 14 is provided for entering of order entry information into the apparatus 10. However, if so desired, a keypad 31, or other means such as a computer mouse (not shown), may be provided for entering customer order entry information. Additionally, instead of issuing a claim number, the claim pickup receipt may be identified by a particular color and/or shape. For example, the claim check could be simply a color like red, yellow, green, or a figure imprinted on the claim check, for example, a ball, rectangle, square, or bunny-shaped figure, etc.

Figure 3:
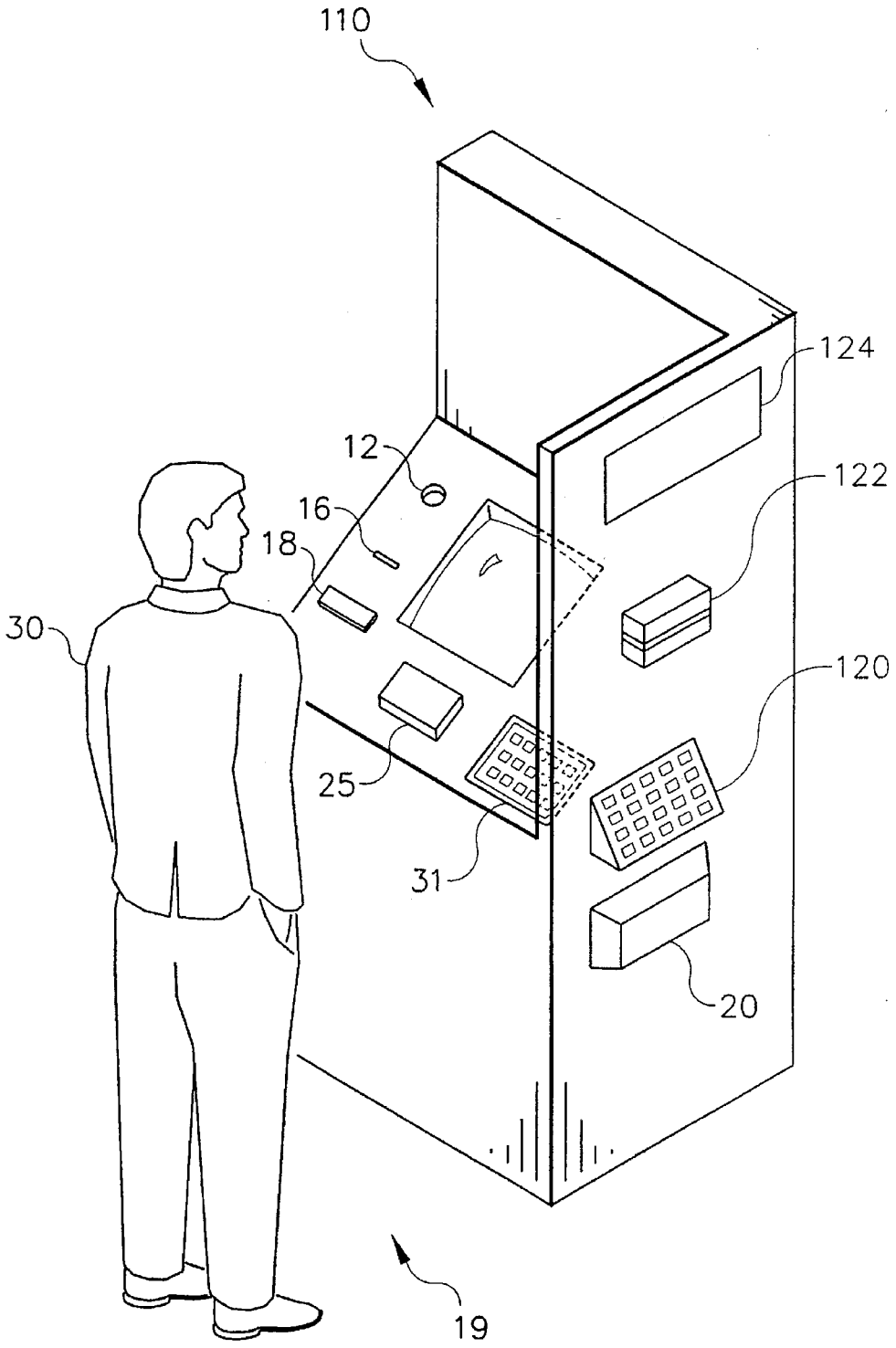
FIG. 3 illustrates a modified photofinishing apparatus also made in accordance with the present invention.

Referring to FIG. 3, there is illustrated a modified form of the present invention. In particular, apparatus 110 is provided which is similar to apparatus 10, like numerals indicating like parts and operation. In this embodiment, a display 124 is placed on the device at a location separate from the workstation 19 such that a second customer can be at the apparatus and would have the ability to query the apparatus 110 only to see if the order is ready. This can be particularly useful if the customer comes back at a time period beyond the predetermined time in which the order is normally scrolled on display 124. In this embodiment a data entry mechanism is provided for allowing the second customer to enter the claim number. In the embodiment illustrated a keypad 120 is provided. Alternatively, a barcode reader 122 could be provided for reading of a barcode 123, in addition to, or in place of identification number 23 (see FIG. 2), placed on claim check 22. This would minimize any order entry error the second customer may make. The display 124 would then display the status for that particular customer. The display 124 would then go back to displaying completed orders as programmed.

In the embodiment illustrated in FIG. 3, the delivery mechanism 20 is also disposed apart from the workstation 19 so as to allow the second customer to pick up the order if the order has been prepaid.

In the embodiment the claim check 23 is used to identify the customer. If desired, the credit card used-by the customer to place the order can also be used to identify the customer picking up the order. This provides additional security in avoiding an order from being taken by the incorrect person.

Instead of providing complete photofinishing and printing as described in apparatuses 10,110, there can be provided a kiosk where photofinishing customer orders are simply placed and completed orders are picked-up. The kiosk would be similar to apparatus 10, except the film development and printing of the prints would be accomplished by a lab technician at a different location. The completed order would then be put in some storage and sorting mechanism provided in the kiosk. Preferably, the lab technician would be located at the lab directly adjacent the kiosk.

It is to be understood that various other changes and modifications may be made without departing from the scope of the present invention, the present invention being limited by the following claims.

Parts List:

10 . . . apparatus
12 . . . film acceptance mechanism
14 . . . video display
16 . . . payment mechanism
18 . . . claim check printer
19 . . . workstation
20 . . . delivery mechanism
21 . . . central processing unit
22 . . . claim check
23 . . . identification number
24 . . . status display 25 . . . scanning device
27 . . . input port
29 . . . computer disc reader
30 . . . customer
31 . . . keypad
110 . . . apparatus
120 . . . keypad
122 . . . barcode reader
123 . . . barcode
124 . . . display

We claim:

1. A kiosk for receiving undeveloped film and for delivering prints and the developed film to a customer, comprising:

a workstation having means for interaction of a customer at the apparatus thereby providing instructions to the customer for starting processing of an undeveloped photosensitive material, said workstation including a first display device for providing instructions and information to the customer for use in said apparatus, data entering means for entering data responsive to said instructions, acceptance means for receiving image data, means for issuing a unique identification indica; and a second display device visually separate from said workstation for displaying the status of various customer orders.

2. A kiosk according to claim 1 further comprising delivery mechanism for delivering a completed customer order.

3. A kiosk according to claim 2 wherein said delivery mechanism is disposed separate and apart from said workstation.

4. A kiosk according to claim 1 wherein said acceptance means for receiving image data comprises a device for receiving a film cartridge having a roll of unexposed undeveloped film.

5. A kiosk according to claim 1 wherein said means for receiving image data comprises a scanner for scanning film and/or prints.

6. A kiosk according to claim 1 wherein said acceptance means for receiving image data comprises a device for receiving a digital record of at least one image.

7. A kiosk according to claim 1 wherein said identification indica comprises a claim check.

8. A kiosk according to claim 1 wherein said identification indica comprises a customer name.

9. A kiosk according to claim 1 wherein said identification indica comprises a credit card number.

10. A kiosk according to claim 1 wherein said identification indica comprises a phone number.

11. A kiosk according to claim 7 further comprising a bar-code reader disposed at a location separate from said workstation, said barcode reader capable of reading a barcode placed on said claim check.

12. A kiosk according to claim 1 further comprising order entry means separate from said workstation for entering said unique identification indica for determining the status of said order.

13. A kiosk according to claim 1 wherein said unique identification indica comprises a number.

14. A kiosk according to claim 1 wherein said unique identification indica comprises a symbol.

15. A kiosk according to claim 1 wherein said first display device is a CRT.

16. A kiosk according to claim 15 wherein said CRT comprises a touch screen which incorporates said means for entering data.

17. A kiosk according to claim 1 wherein said data entering means comprises a touch keypad.

18. An automated, interactive photofinishing apparatus for receiving undeveloped film, developing the film, printing prints from said developed film, storing of said developed film and prints, and means for dispensing said developed film and associated prints, comprising:

a workstation having means for interaction of a customer at the apparatus thereby providing instructions to the customer for starting processing of an undeveloped photosensitive material, said workstation including a first display device for providing instructions and information to the customer for use in said apparatus data entering means for entering data responsive to said instructions, acceptance means for receiving image data, means for issuing a unique identification indica; and a second display device visually separate from said workstation for displaying the status of various customer orders.

19. An automated interactive photofinishing apparatus according claim 18 further comprising a delivery mechanism for delivering a completed customer order.

20. An automated interactive photofinishing apparatus according claim 18 wherein said delivery mechanism is disposed separate and apart from said entry station.

21. An automated interactive photofinishing apparatus according claim 18 wherein said acceptance means for receiving image data comprises a device for receiving a film cartridge having a roll of unexposed undeveloped film.

22. An automated interactive photofinishing apparatus according claim 18 wherein said means for receiving image data comprises a scanner for scanning film and/or prints.

23. An automated interactive photofinishing apparatus according claim 18 wherein said acceptance means for receiving image data comprises a device for receiving a digital record of at least one image.

24. A kiosk according to claim 18 wherein said identification indica comprises a claim check.

25. A kiosk according to claim 18 wherein said identification indica comprises a customer name.

26. A kiosk according to claim 18 wherein said identification indica comprises a credit card number.

27. A kiosk according to claim 18 wherein said identification indica comprises a phone number.

28. An automated interactive photofinishing apparatus according claim 18 further comprising a barcode reader disposed at a location separate from said workstation, said barcode reader capable of reading a barcode placed on said claim check.

29. An automated interactive photofinishing apparatus according claim 18 further comprising order entry means separate from said workstation for entering said unique identification indica for determining the status of said order.

30. An automated interactive photofinishing apparatus according claim 18 wherein said unique identification indica comprises a number.

31. An automated interactive photofinishing apparatus according claim 18 wherein said unique identification indica comprises a symbol.

32. An automated interactive photofinishing apparatus according claim 18 wherein said first display device is a CRT.

33. An automated interactive photofinishing apparatus according claim 32 wherein said CRT comprises a touch screen which incorporated said means for entering data.

34. An automated interactive photofinishing apparatus according claim 18 wherein said data entering means comprises a touch keypad.

* * * * *